US007032830B2

(12) United States Patent
Ekelöf

(10) Patent No.: US 7,032,830 B2
(45) Date of Patent: Apr. 25, 2006

(54) METHOD AND DEVICE FOR GENERATING A LIQUID MIST

(75) Inventor: Anders Ekelöf, Onsala (SE)

(73) Assignee: Forsvarets Materielverk, Stockholm (SE)

( * ) Notice: Subject to any disclaimer, the term of this patent is extended or adjusted under 35 U.S.C. 154(b) by 0 days.

(21) Appl. No.: 10/471,595

(22) PCT Filed: Mar. 22, 2002

(86) PCT No.: PCT/SE02/00581

§ 371 (c)(1),
(2), (4) Date: Sep. 23, 2003

(87) PCT Pub. No.: WO02/076817

PCT Pub. Date: Oct. 3, 2002

(65) Prior Publication Data

US 2004/0074980 A1 Apr. 22, 2004

(30) Foreign Application Priority Data

Mar. 23, 2001 (SE) ..... 0101041

(51) Int. Cl.
*A62C 5/02* (2006.01)
*A62C 31/00* (2006.01)
*B05B 7/04* (2006.01)
*B05B 7/08* (2006.01)

(52) U.S. Cl. ..... 239/8; 239/434; 239/398; 239/426; 239/424.5

(58) Field of Classification Search ..... 239/1, 239/8, 9, 10, 398, 418, 419, 424, 424.5, 427.5, 239/419.3, 422, 548, 567, 426, 434
See application file for complete search history.

(56) References Cited

U.S. PATENT DOCUMENTS

| | | | | | |
|---|---|---|---|---|---|
| 2,832,528 | A | * | 4/1958 | Spears, Jr. | 138/34 |
| 3,709,433 | A | * | 1/1973 | Obergefell et al. | 239/8 |
| 3,908,903 | A | * | 9/1975 | Burns, Jr. | 239/2.2 |
| 4,314,670 | A | * | 2/1982 | Walsh, Jr. | 239/11 |
| 5,083,707 | A | * | 1/1992 | Holden | 239/2.2 |
| 5,146,759 | A | * | 9/1992 | Eguchi et al. | 62/64 |
| 5,323,861 | A | * | 6/1994 | Kaidonis et al. | 169/45 |
| 5,411,208 | A | * | 5/1995 | Burgener | 239/8 |
| 5,520,331 | A | * | 5/1996 | Wolfe | 239/8 |

FOREIGN PATENT DOCUMENTS

| | | |
|---|---|---|
| DE | 32 17 336 | 3/1983 |
| DE | 37 06 781 | 9/1988 |
| DE | 44 10 112 | 8/1994 |
| EP | 0 221 469 | 5/1987 |
| FR | 2 517 319 | 6/1983 |

* cited by examiner

*Primary Examiner*—Davis Hwu
(74) *Attorney, Agent, or Firm*—Jacobson Holman PLLC

(57) ABSTRACT

A device and a method for generating a mist for camouflaging ships, vehicles, air vehicles and stationary objects within infrared and radar wavelengths. The device generates mist by a liquid, for instance water, being injected into a flow of air which is supplied from an air duct, through a nozzle directed towards the flow of air. The flow of air atomizes the liquid and spreads the atomized liquid as a mist.

16 Claims, 2 Drawing Sheets

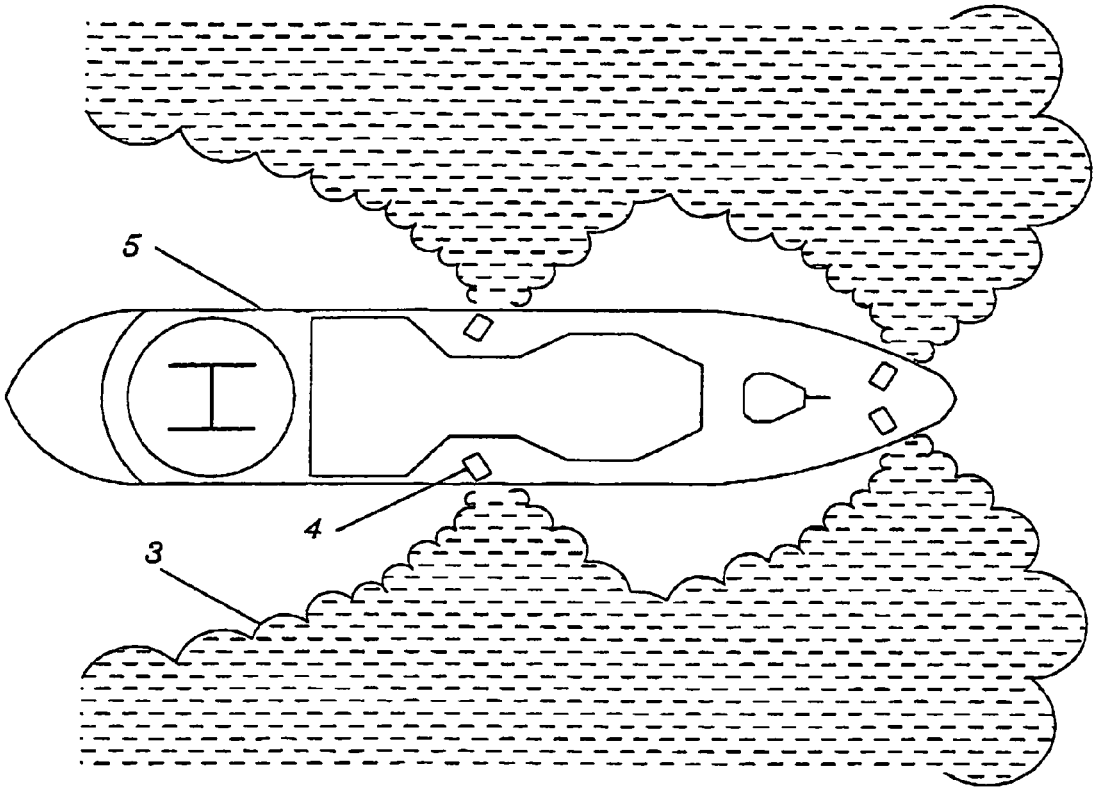
FIG. 1
FIG. 3
FIG. 2
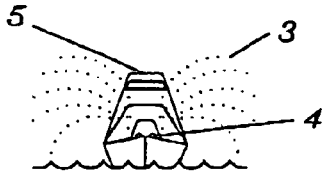
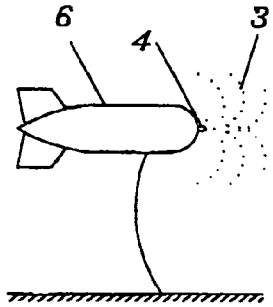
FIG. 4
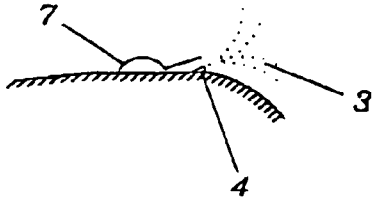

METHOD AND DEVICE FOR GENERATING A LIQUID MIST

This is a nationalization of PCT/SE02/00581 filed Mar. 22, 2002 and published in English.

BACKGROUND OF THE INVENTION

1. Field of the Invention

The present invention relates to a method and a device for generating a liquid mist for camouflage of, inter alia, ships, land vehicles, air vehicles and stationary objects, and as decoy within the infrared and radar wavelengths.

2. Description of the Related Art

It is known that mist, for instance water mist, can be used to camouflage an objector to produce decoys. If an object is covered by water mist, it will be difficult to discover by IR measurement and radar. By controlling temperature and/or size of droplets of the liquid used to generate the mist, it is possible to produce not only camouflage but also a mist which is an effective decoy for radar or IR homing devices.

Known devices for generating mist are using nozzles to atomise the liquid and spread the mist. Liquid under high pressure is used to produce the droplets that are necessary. Patent Specification EP 0 221 469 B discloses an example of a device for producing a decoy or camouflage by generating a mist. In this device, the mist is generated by means of water projectors provided with atomiser nozzles. The liquid is ejected intermittently through the nozzles. A drawback of intermittent spreading of mist is that there is a risk that a first layer of mist has time to drift away before the next layer has been positioned, which increases the risk of discovery.

German Patent Specification DE 37 06 781 A1 discloses a device for generating and spreading a continuous water mist, comprising a plurality of pairs of nozzles consisting of one nozzle for atomising of liquid and one nozzle arranged at an angle thereto and intended for compressed air. Water is ejected through the atomiser nozzle in the form of a layer of water droplets. This layer is hit by a flow of air from the compressed air nozzle, whereby the layer is spread and forms a mist.

Prior-art technique of generating mist by means of atomiser nozzles, however, suffers from several deficiencies. It takes quite a long time to produce a complete mist, thus requiring a long forewarning time in case of an attack by, for example, homing missiles. An atomiser nozzle generates mist having a predetermined droplet size. The droplet size is most important to the capability of the mist to camouflage an object. A mist intended to make an object invisible to an IR homing device gives poor protection against a radar homing device and vice versa. Therefore at least two types of atomiser nozzles are frequently used, one generating an IR mist and one generating a radar mist: a method requiring much space and making the device expensive. Moreover the device requires a water pressure of 250–300 bar to produce the desired size of droplets, which results not only in a high water and power consumption but also places great demands on pipes, connections and the like. In cold weather, there is also a risk of the atomiser nozzles being clogged by ice and the protected object being covered with ice. There is also a risk that the atomiser nozzles are clogged by dirt particles, especially in cases where the water used is lake water or sea water. This makes it necessary to include price increasing devices for filtering of water in the mist-generating device. Moreover, atomiser nozzles are poor at spreading the generated mist, which makes it necessary to use a plurality of nozzles to generate a sufficient layer of mist also for a small object. All in all, this results in a mist-generating device having a high water and power consumption and including a great number of large and heavy components.

SUMMARY OF THE INVENTION

The object of the present invention is to generate and spread mist in a more efficient way and to design a simpler device than before. A further object is to provide droplets without using space-requiring and heavy installations to produce high water pressures.

The above objects are achieved by a method according to the present invention of generating a mist to provide camouflage or decoys by injecting a liquid into a flow of air, the flow of air being generated in an air duct, and the flow of air atomizing the liquid into droplets of desired size and spreading the droplets as a mist. The present invention also includes a device for generating a mist to provide camouflage including an air duct conducting a flow of air, and a nozzle directed toward the air flow to iniect a liquid therein for atomizing the liquid into droplets of desired size and spreading the droplets.

BRIEF DESCRIPTION OF THE DRAWINGS

The invention will now be described in more detail by way of embodiments and with reference to the accompanying drawings, in which FIG. 1 is a top plan view of a ship equipped with the invention, FIG. 2 shows a ship equipped with the invention, FIG. 3 shows the invention on an air vehicle, FIG. 4 shows the invention adjacent to a stationary object.

DETAILED DESCRIPTION OF THE PREFERRED EMBODIMENTS

Figure 5:
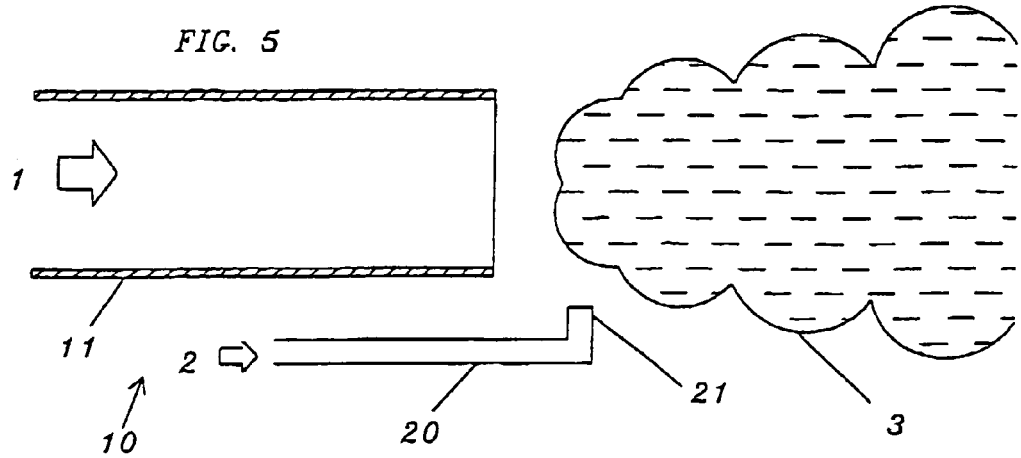
FIG. 5 shows a first embodiment of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIG. 1 shows a ship (5) equipped with a device (4) for generating and spreading mist according to the invention. The device (4) spreads mist (3) round the ship (5). Conveniently the water round the ship is used as liquid to generate the mist (3).

FIG. 2 shows from the front how a ship (5) equipped with a mist-generating device (4) spreads a mist (3). FIG. 3 shows an air vehicle, in this case an aerostat (6), equipped with a mist-generating device (4). Also helicopters, slow aircraft and ground vehicles, such as combat and transport vehicles, can be quipped with mist-generating devices. In these cases, the supply of liquid is not unlimited, as when used on a ship. At the same time the limitations as to space and weight are narrow. Therefore a light and small mist-generating device with a low consumption of liquid, a few litres per minute, is important. FIG. 4 shows a mist-generating device (4) adjacent to a stationary object, for instance artillery (7), bridges, depots and warehouses.

According to the invention, a hot or cold liquid is injected into a flow of air (hot or cold). The flow of air should be strong, at least 30 m/s, but preferably significantly stronger (up to 277 m/s). When the liquid enters the flow of air, the liquid droplets will be atomised. The liquid droplets then continue with the flow of air and form a mist. By varying the speed of the flow of air, the size of the liquid droplets can be affected. An indication of an approaching threat involving a radar homing device results in the liquid droplets of the mist being adjusted to camouflage the object for precisely the radar frequencies in question. Correspondingly, an IR threat results in generation of a special IR mist which camouflages wavelengths within the infrared range. The size and power of absorption of the droplets and, thus, the spectral properties of the mist can also be affected by the design of the air duct, the liquid pressure, additives and the design of the nozzles. For instance, water, optionally with an alkali metal added, for instance sodium, can be used to increase the temperature of the mist still more, or electromagnetically reflecting substances, for instance metal powder, to produce a decoy.

Figure 6:
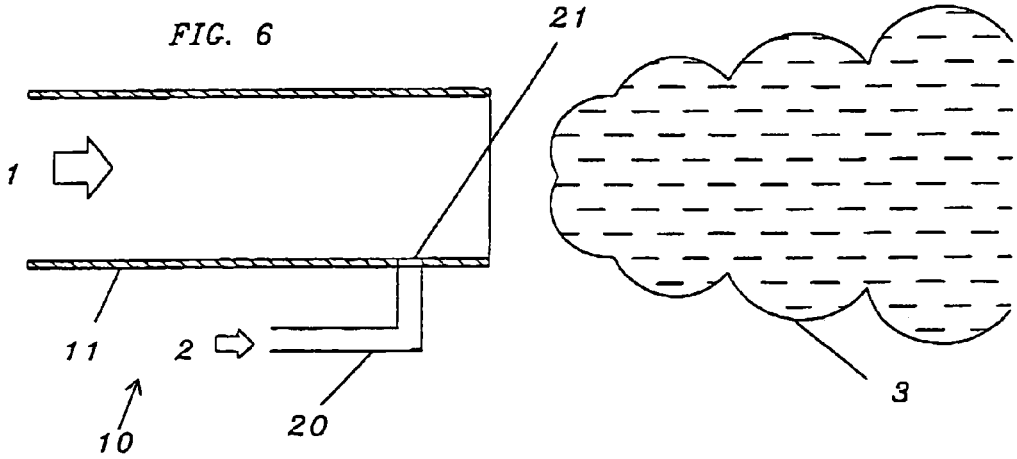
FIG. 6 shows a second embodiment of the invention.
Figure 7:
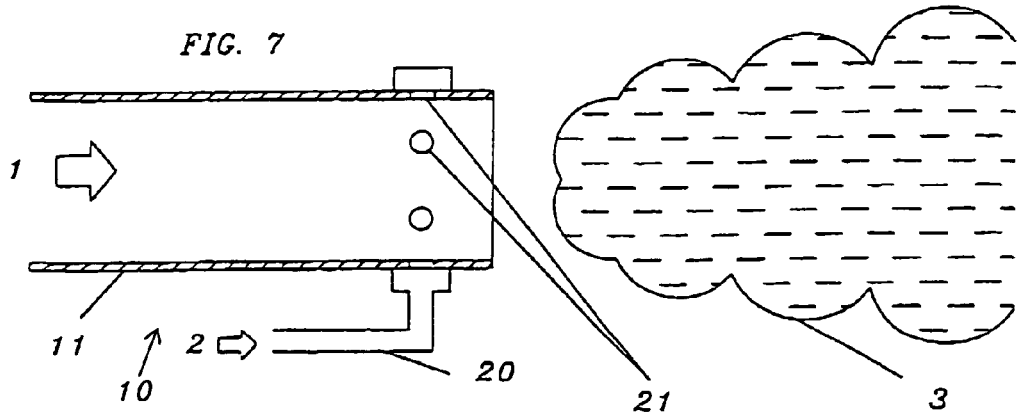
FIG. 7 shows a third embodiment of the invention.

FIGS. 5–7 illustrate different embodiments of the invention. FIG. 5 shows an air duct (10) consisting of a pipe (11) through which a strong flow of air (1) passes. Immediately after the flow of air (8) has left the pipe (11), liquid (2) is injected from a nozzle (21) into the flow of air (1). The flow of air (1) which has a high speed, above 30 m/s, atomises the injected liquid in droplets and spreads the droplets which form a mist (3).

FIG. 6 illustrates an embodiment where the liquid (2) is injected into the flow of air (1) before the flow of air has left the pipe (11). FIG. 7 shows a third embodiment where a number of nozzles (21) are arranged in the pipe (11). The nozzles need not be arranged in the wall of the pipe but may also be arranged inside the pipe, for instance one nozzle arranged in the centre of the pipe and the flow of air or a plurality of nozzles arranged concentrically in the flow of air.

The invention presents a number of advantages compared with prior art. Among other things, the liquid is atomised in two steps, first through the nozzle (21) and then through further atomising in the flow of air (1) instead of in an atomiser nozzle, like in prior-art solutions. Therefore an atomiser nozzle is not necessary, but may be used, which means that the liquid pressure can be considerably lower and that the risk of clogging of the nozzle owing to dirt particles in the liquid decreases. Moreover, the flow of air is used to spread the mist in an efficient manner. The flow of air (1) is conducted in an air duct (10) which has a great exhaust capacity and manages a considerably greater flow of air than a nozzle. The device according to the invention can spread mist in a more efficient manner using a considerably smaller number of components compared with prior art. As a result, the weight of the device will be relatively low compared to the generated amount of mist, and only one or a few exhaust means are required. It will also be possible to use a lower water pressure, which means that the power requirement is smaller.

As illustrated in FIGS. 1–4, the invention can be used on many different vehicles and objects. Particularly those that are already equipped with exhaust means, for instance exhaust pipes or ventilation, can without much modification and in an inexpensive manner be equipped with protection that has so far been reserved for large vehicles and installations. The advantage of using the invention in connection with exhaust pipes and the like is, in addition to a camouflaging mist, that the exhaust gases are cooled, thus reducing the IR signature of the vehicle still more. The lower liquid pressure also makes it possible to use water from an existing sprinkler installation or the like. Moreover, the low water consumption of the device implies that also smaller vehicles, such as combat and transport vehicles, can carry a sufficient amount of liquid to provide an effective camouflaging mist.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A device for generating a mist to provide camouflage or a decoy comprising:

an air duct conducting a flow of air at a speed of between 30 and 150 m/s; and a nozzle directed at an angle substantially perpendicular to said air flow to inject a liquid into said air flow at said angle for atomizing said liquid into droplets of desired size and spreading said droplets, said nozzle injecting said liquid at a pressure of between 3 to 10 bar.

2. The device as set forth in claim 1, wherein said air duct is a pipe that includes a plurality of nozzles for injecting said liquid.

3. The device as set forth in claim 1, wherein said plurality of nozzles are arranged concentrically in the air flow.

4. The device as set forth in claim 1, wherein said nozzle injects said liquid into the air flow after said air flow has exited said air duct.

5. The device as set forth in claim 1, wherein said nozzle injects said liquid into the air flow before said air flow leaves said air duct.

6. The device as set forth in claim 5, wherein said nozzle is arranged through an opening in a wall of said air duct so as to be generally perpendicular to said air duct wall.

7. A method of providing camouflage or a decoy, said method comprising the steps of:

generating a flow of air in an air duct, said flow of air moving in a first direction and having a speed of between 30 and 150 m/s;

injecting a liquid into said flow of air in a second direction that is substantially perpendicular to said first direction, said liquid having a pressure of between 3 and 10 bar; and atomizing the liquid into droplets of desired size and spreading the droplets as a mist to provide said camouflage or decoy.

8. The method as set forth in claim 7, wherein said step of injecting liquid includes injecting liquid into said air duct through at least one nozzle.

9. The method as set forth in claim 7, wherein the step of atomizing to obtain the desired size of said droplets is controlled by controlling said speed of said air flow.

10. The method as set forth in claim 7, wherein said step of injecting liquid includes injecting water.

11. The method as set forth in claim 10, wherein said step of injecting liquid further includes injecting at least one of a substance that affects an absorption property of said mist, a substance that affects a coherence of said liquid and a substance that affects a freezing point of said liquid.

12. A method of providing camouflage or a decoy by generating a mist, said method comprising the steps of:

generating a flow of air in an air duct, said flow of air having a speed of between 30 and 150 m/s;

injecting a liquid that includes water and has a pressure of between 3 and 10 bar into said flow of air, said step of injecting including injecting at least one of a substance that affects an absorption property of said mist, a substance that affects a coherence of said liquid and a substance that affects a freezing point of said liquid; and atomizing the liquid into droplets of desired size and spreading the droplets as mist to provide said camouflage or decoy.

13. The method as set forth in claim 12, wherein said step of injecting a liquid further includes injecting liquid into said air duct through at least one nozzle.

14. The method as set forth in claim 13, wherein said nozzle injects said liquid into the air flow before said air flow leaves said air duct, said nozzle being arranged through an opening in a wall of said air duct so as to be generally perpendicular to said air duct.

15. The method as set forth in claim 12, wherein said step of injecting a liquid includes injecting said liquid into the air flow before said air flow leaves said air duct.

16. The method as set forth in claim 12, wherein the step of atomizing to obtain the desired size of said droplets is controlled by controlling said speed of said air flow.

* * * * *